US011646512B2

(12) United States Patent
Yada et al.

(10) Patent No.: US 11,646,512 B2
(45) Date of Patent: May 9, 2023

(54) CONTACT

(71) Applicant: KITAGAWA INDUSTRIES CO., LTD., Inazawa (JP)

(72) Inventors: Tetsuya Yada, Kasugai (JP); Tatsuya Nakamura, Kasugai (JP)

(73) Assignee: KITAGAWA INDUSTRIES CO., LTD., Inazawa (JP)

( * ) Notice: Subject to any disclaimer, the term of this patent is extended or adjusted under 35 U.S.C. 154(b) by 251 days.

(21) Appl. No.: 17/292,240

(22) PCT Filed: May 20, 2019

(86) PCT No.: PCT/JP2019/019858
§ 371 (c)(1),
(2) Date: May 7, 2021

(87) PCT Pub. No.: WO2020/095469
PCT Pub. Date: May 14, 2020

(65) Prior Publication Data

US 2022/0006210 A1 Jan. 6, 2022

(30) Foreign Application Priority Data

Nov. 8, 2018 (JP) ..... JP2018-210508

(51) Int. Cl.
*H01R 12/00* (2006.01)
*H01R 12/52* (2011.01)
*H01R 12/57* (2011.01)

(52) U.S. Cl.
CPC ..... *H01R 12/52* (2013.01); *H01R 12/57* (2013.01)

(58) Field of Classification Search
CPC ..... H01R 12/52; H01R 12/55; H01R 12/57
(Continued)

(56) References Cited

U.S. PATENT DOCUMENTS

2012/0171909 A1 7/2012 Harada
2016/0294095 A1 10/2016 Kim et al.
2019/0190184 A1 6/2019 Nakamura et al.

FOREIGN PATENT DOCUMENTS

CN 102938512 A 2/2013
JP 2011-060694 A 3/2011
(Continued)

OTHER PUBLICATIONS

Partial English translation of Written Opinion of IPEA for PCT/JP2019/019858, dated Nov. 17, 2020, 2 pages.
(Continued)

*Primary Examiner* — Khiem M Nguyen
(74) *Attorney, Agent, or Firm* — Meunier Carlin & Curfman LLC

(57) ABSTRACT

[Object] To provide a contact that can hold down effects caused by solder, even if an elastic contacting portion is extending from a location contacting a first member.
[Solving means] The contact includes a base portion, an elastic contacting portion and a gap forming portion. The base portion is configured solderable on a component mounting surface of the first member. The elastic contacting portion is configured elastically deformable and relatively swingable with respect to the base portion, and when contacting a contacted surface of the second member, is configured to elastically deform to be in pressurized contact with the contacted surface. In the gap forming portion, a concave portion is provided between a first end portion and a second end portion, and is configured to have a gap between the concave portion and the component mounting surface when the base portion is soldered on the component mounting surface in a state in which the concave portion and the component mounting surface are oriented in directions facing each other.

13 Claims, 8 Drawing Sheets

(58) Field of Classification Search
USPC ..... 439/65, 83
See application file for complete search history.

(56) References Cited

FOREIGN PATENT DOCUMENTS

| | | | |
|---|---|---|---|
| JP | 2014-029809 | A | 2/2014 |
| JP | 2017-220426 | A | 12/2017 |

OTHER PUBLICATIONS

English translation of International Preliminary Report on Patentability for PCT/JP2019/019858, dated May 14, 2021, 5 pages.
Extended European search report dated Oct. 19, 2022 for the corresponding European patent application No. 19881588.8.
International Search Report for PCT/JP2019/019858, dated Jul. 23, 2019, 4 pages.
Written Opinion of IPEA for PCT/JP2019/019858, dated Nov. 17, 2020, 5 pages.
International Preliminary Report on Patentability, dated Feb. 16, 2021, 13 pages.

CONTACT

TECHNICAL FIELD

The present invention relates to a contact.

BACKGROUND ART

There is known a contact used in EMC (electromagnetic compatibility) countermeasures of electronic circuit boards. A contact described in Patent Document 1 is surface mounted on a first member (for example, electronic circuit board) and is in pressurized contact with a second member (for example, a panel of a chassis) at an elastic contacting portion, to electrically connect the first member with the second member.

CITATION LIST

Patent Document

Patent Document 1: Japanese Unexamined Patent Publication No. 2014-29809

SUMMARY OF INVENTION

Technical Problem

In such aforementioned contact, the elastic contacting portion may be configured by a band-shaped sheet metal in which an elastic contacting portion extends from a base portion. In this case, if the elastic contacting portion extends from a location contacting the first member, solder melting in the soldering process may enter into a location being a boundary of the base portion and the elastic contacting portion, and form a solder fillet at a position contacting the elastic contacting portion. Once in such a condition, the elastic contacting portion is restricted by the solder fillet. This may prevent the spring property from being effective as designed.

In one aspect of the present disclosure, it is desirable to provide a contact that can hold down effects caused by the solder even if the elastic contacting portion extends from a location contacting the first member.

Solution to Problem

One aspect of the present disclosure is a contact capable of electrically connecting a first member and a second member, the contact comprising: a base portion; an elastic contacting portion; and a gap forming portion. The base portion is configured solderable on a component mounting surface of the first member. The elastic contacting portion is configured elastically deformable and relatively swingable with respect to the base portion, and, when contacting a contacted surface of the second member, is configured to elastically deform to be in pressurized contact with the contacted surface. The gap forming portion is formed integrally with the base portion and the elastic contacting portion, and is configured to connect with the base portion at a first end portion and connect with the elastic contacting portion at a second end portion on an opposite side of the first end portion, wherein the first end portion and the second portion have a concave portion provided therebetween, and the gap forming portion is configured to have a gap between the concave portion and the component mounting surface when the base portion is soldered on the component mounting surface in a state in which the concave portion and the component mounting surface are oriented to face each other.

According to the contact as configured as such, a gap forming portion is provided between the base portion and the elastic contacting portion, and when the base portion is soldered on the component mounting surface, a gap is formed between the first member and a concave portion of the gap forming portion. Therefore, when the base portion is soldered on the first member, even if the solder melts between the base portion and the first member, it is extremely low in possibility that the molten solder reaches the elastic contacting portion overwhelming the location of the gap. Accordingly, it is possible to prevent a solder fillet from forming at one end of the elastic contacting portion, thus allowing for the elastic contacting portion to function with the spring property as designed.

DESCRIPTION OF EMBODIMENTS

Next describes the aforementioned contact by raising an illustrative embodiment.

(1) First Embodiment

[Configuration of Contact]

Figure 1A:
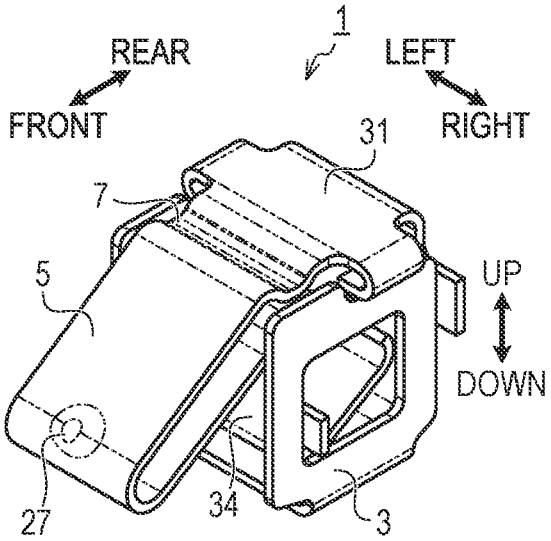
FIG. 1A is a perspective view of a contact of a first embodiment viewed from an upper right front side.
Figure 1B:
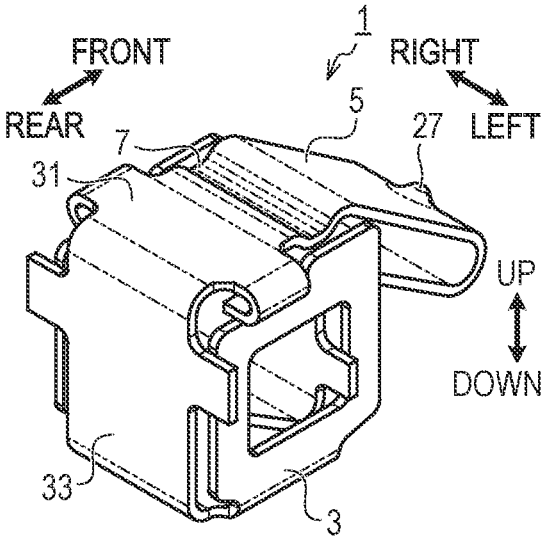
FIG. 1B is a perspective view of the contact of the first embodiment viewed from an upper left rear side.
Figure 1C:
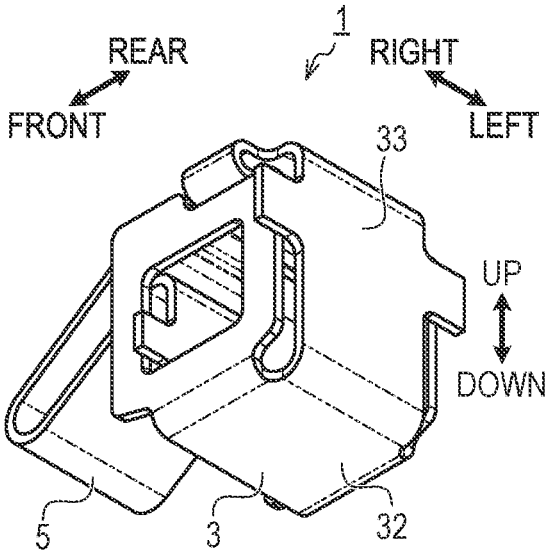
FIG. 1C is a perspective view of the contact of the first embodiment viewed from a lower right rear side.
Figure 1D:
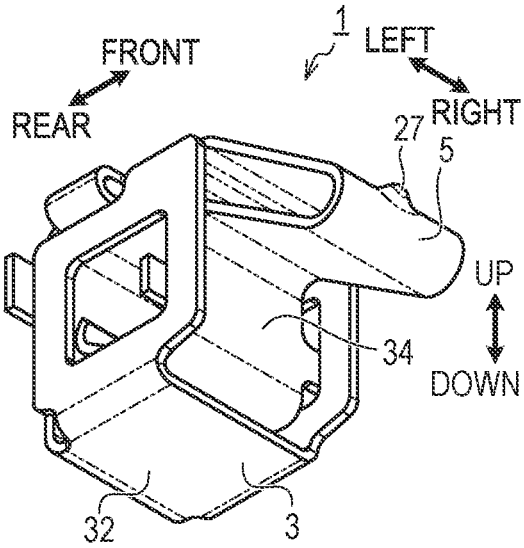
FIG. 1D is a perspective view of the contact of the first embodiment viewed from a lower left front side.
Figure 2A:
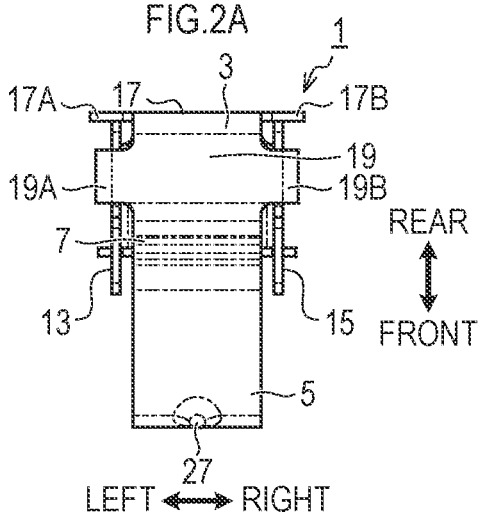
FIG. 2A is a plan view of the contact of the first embodiment.
Figure 2B:
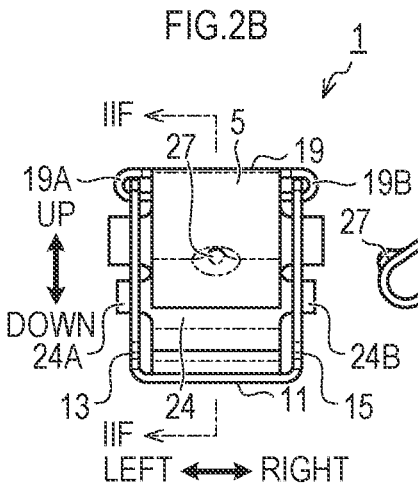
FIG. 2B is a front view of the contact of the first embodiment.
Figure 2C:
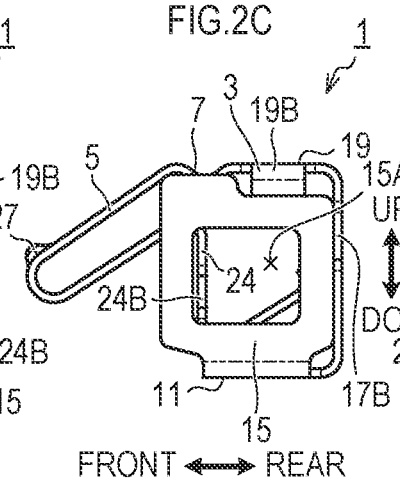
FIG. 2C is a right side view of the contact of the first embodiment.
Figure 2D:
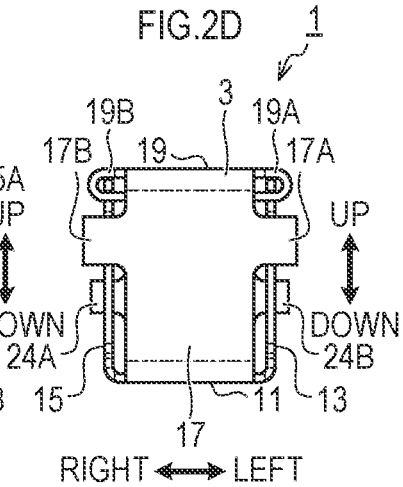
FIG. 2D is a rear view of the contact of the first embodiment.
Figure 2E:
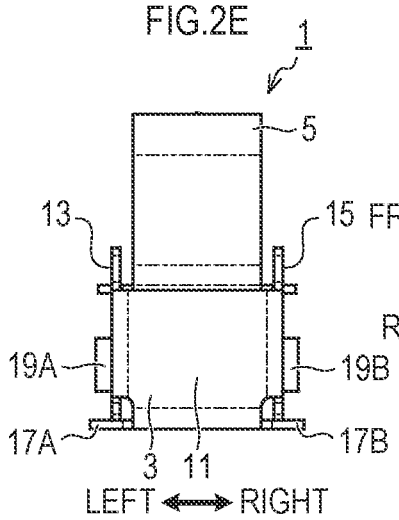
FIG. 2E is a bottom view of the contact of the first embodiment.

In the following description, a direction in which a part shown in the plan view of FIG. 2A is oriented is defined as up, a direction in which a part shown in the front view of FIG. 2B is oriented is defined as front, a direction in which a part shown in the right side view of FIG. 2C is oriented is defined as right, the opposite direction of right is defined as left, a direction in which a part shown in the rear view of FIG. 2D is oriented is defined as rear, and a direction in which a part shown in the bottom view of FIG. 2E is oriented is defined as down. However, these directions are merely directions defined for concisely describing relative positions of each portion configuring a contact 1. Therefore, in which direction the contact 1 is oriented for example at a time of shipping, using or the like of the contact 1 is undetermined. A left side view of the contact 1 is represented as symmetrical to its right side view.

The contact 1 illustrated in FIGS. 1A, 1B, 1C, and 1D includes a base portion 3, an elastic contacting portion 5, and a gap forming portion 7. The base portion 3, the elastic contacting portion 5 and the gap forming portion 7 are formed integrally by a metal thin plate (in the present embodiment, a thin plate of beryllium copper for a spring with reflow tin plating).

The base portion 3 is a part secured with a rigidity of a degree that substantially does not cause deformation even if outer force assumed at the time of using the contact 1 is applied. The base portion 3 has, as illustrated in FIGS. 2A, 2B, 2C, 2D, 2E and the like, a bottom plate portion 11, a left wall portion 13, a right wall portion 15, a rear wall portion 17, and a top plate portion 19. The left wall portion 13 bends from a left end of the bottom plate portion 11 and extends upwards. The left wall portion 13 is formed having a left opening 13A. The right wall portion 15 bends from a right end of the bottom plate portion 11 and extends upwards. The right wall portion 15 is formed having a right opening 15A.

The rear wall portion 17 bends from a rear end of the bottom plate portion 11 and extends upwards. The rear wall portion 17 is provided with a left protruding piece 17A protruding in a left direction from a left end of the rear wall portion 17, and a right protruding piece 17B protruding in a right direction from a right end of the rear wall portion 17. The left protruding piece 17A abuts a rear end of the left wall portion 13 at its front surface. The right protruding piece 17B abuts a rear end of the right wall portion 15 at its front surface. The top plate portion 19 bends from an upper end of the rear wall portion 17 and extends forwards. The top plate portion 19 is provided with a left folding piece 19A extending leftwards from a left end of the top plate portion 19 and bending downwards at the left end then folding back rightwards, and a right folding piece 19B extending rightwards from a right end of the top plate portion 19 and bending downwards at the right end then folding back leftwards. The left folding piece 19A abuts an upper end of the left wall portion 13 at its lower surface. The right folding piece 19B abuts an upper end of the right wall portion 15 at its lower surface.

Figure 2F:
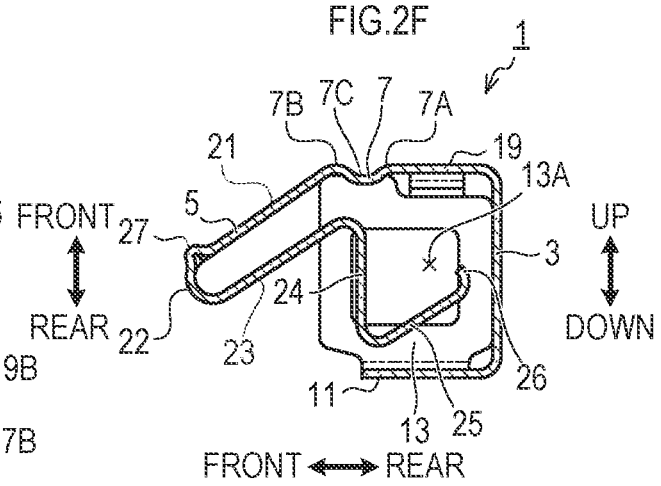
FIG. 2F is a cross-sectional view of a cross section taken on line IIF-IIF in FIG. 2B.

The elastic contacting portion 5 is a part that elastically deforms upon receiving outer force intended at the time of using the contact 1. The elastic contacting portion 5 is configured relatively swingable with respect to the base portion 3. The elastic contacting portion 5 is configured of a band-shaped sheet metal extending in a band shape from the gap forming portion 7. More specifically, the elastic contacting portion 5 has, as illustrated in FIG. 2F and the like, a first inclined portion 21, a front end folded portion 22, a second inclined portion 23, a front wall portion 24, a third inclined portion 25, a rear end bent portion 26, and a projecting portion 27.

The first inclined portion 21 extends towards a diagonally lower front direction from the gap forming portion 7. The front end folded portion 22 is configured bending downwards from a front end of the first inclined portion 21 and folding diagonally upwards towards the rear. Namely, the front end folded portion 22 is formed by the aforementioned band-shaped sheet metal being folded about a center of curvature being an axis parallel to a width direction of the band-shaped sheet metal (left-right direction in the drawing). This front end folded portion 22 configures a protruding direction tip portion of the elastic contacting portion 5. The second inclined portion 23 extends diagonally upwards towards the rear from the front end folded portion 22.

The front wall portion 24 bends from a rear end of the second inclined portion 23 and extends downwards. The front wall portion 24 is provided with, as illustrated in FIGS. 2B, 2C, 2D and the like, a left restricting piece 24A protruding leftwards from a left end of the front wall portion 24, and a right restricting piece 24B protruding rightwards from a right end of the front wall portion 24. The left restricting piece 24A is arranged at a position penetrating through the left wall portion 13 through the left opening 13A. The right restricting piece 24B is arranged at a position penetrating through the right wall portion 15 through the right opening 15A. When the elastic contacting portion 5 swings, a movable range of the left restricting piece 24A is restricted to within a range of the left opening 13A, and a movable range of the right restricting piece 24B is restricted to within a range of the right opening 15A. The third inclined portion 25 bends from a lower end of the front wall portion 24 and extends diagonally upwards toward the rear. The rear end bent portion 26 is configured in such a manner that a part extending from a rear end of the third inclined portion 25 bends upwards. The projecting portion 27 is provided around the protruding direction tip portion of the elastic contacting portion 5.

The base portion 3 has, as illustrated in FIGS. 1A, 1B, 1C, and 1D, a first bonding surface 31, a second bonding surface 32, and a third bonding surface 33. The first bonding surface 31 is an upper surface of the top plate portion 19. The second bonding surface 32 is a lower surface of the bottom plate portion 11. The third bonding surface 33 is a rear surface of the rear wall portion 17. The first bonding surface 31 and the second bonding surface 32 are arranged parallel to each other, and are oriented in opposite directions (upper and lower in the drawing). The third bonding surface 33 is oriented in a direction perpendicular to (rear of in the drawing) the directions in which the first bonding surface 31 and the second bonding surface 32 are oriented (upper and lower in the drawing). The elastic contacting portion 5 is provided with a flat surface 34. The flat surface 34 is a front surface of the front wall portion 24. The third bonding surface 33 and the flat surface 34 are arranged parallel to each other and oriented in opposite directions (left side and right side in the drawing).

Figure 3A:
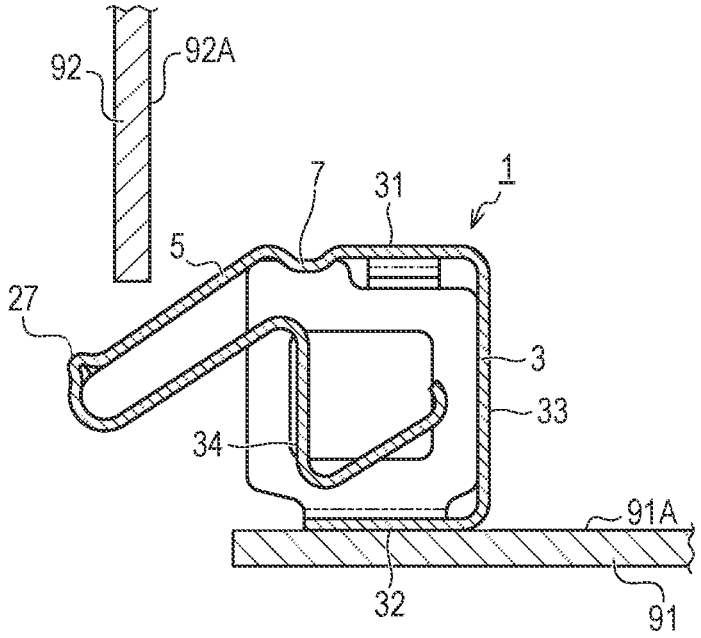
FIG. 3A is a cross-sectional view illustrating the contact of the first embodiment soldered on a first member at a second bonding surface.
Figure 3B:
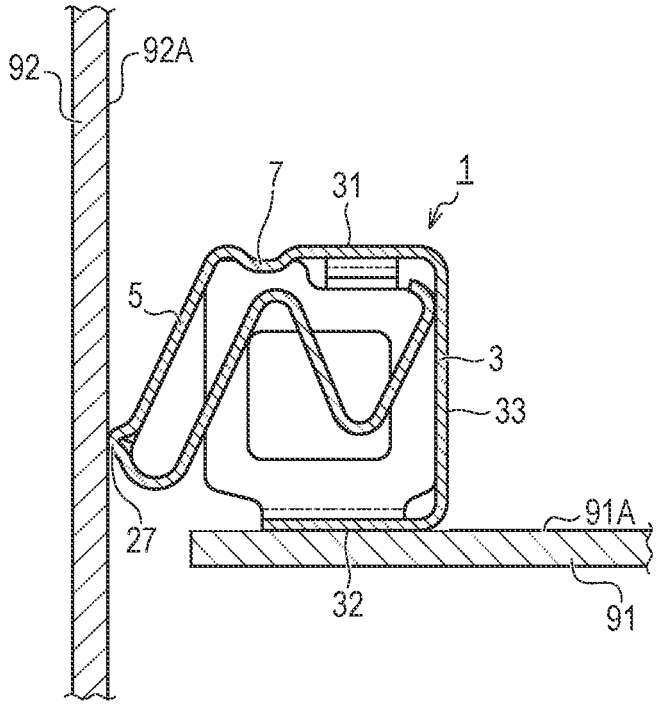
FIG. 3B is a cross-sectional view illustrating a state in which the contact of the first embodiment soldered on the first member at the second bonding surface is in pressurized contact with the second member.

The contact 1 is configured solderable by using any one of the first bonding surface 31, second bonding surface 32 and third bonding surface 33. FIGS. 3A and 3B illustrate the contact 1 soldered on a component mounting surface 91A of a first member 91 by using the second bonding surface 32. In a case in which the second bonding surface 32 is soldered on the component mounting surface 91A, the first bonding surface 31 may be used as a suction surface for sucking with a suction nozzle of an automatic mounting machine. In the case in which the contact 1 is soldered on the first member 91 at the second bonding surface 32, when any one of the first member 91 and the second member is relatively moved with respect to the other from a position illustrated in FIG. 3A to a position illustrated in FIG. 3B, the elastic contacting portion 5 is in pressurized contact at the projecting portion 27 with a contacted surface 92A of the second member 92.

Figure 4A:
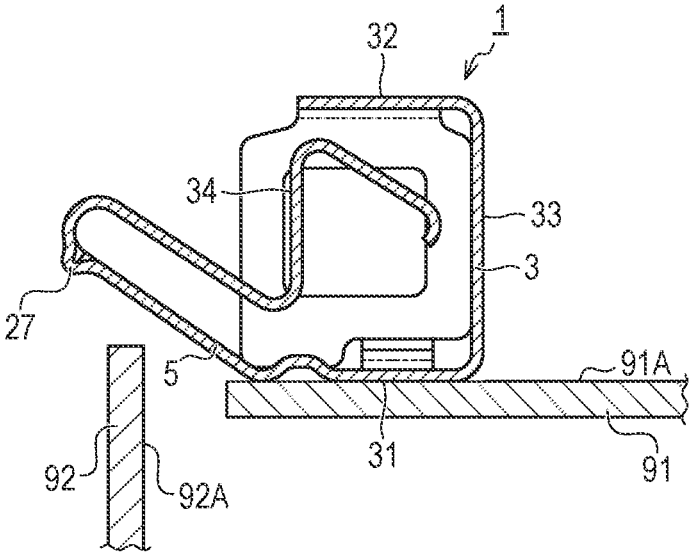
FIG. 4A is a cross-sectional view illustrating the contact of the first embodiment soldered on the first member at the first bonding surface.
Figure 4B:
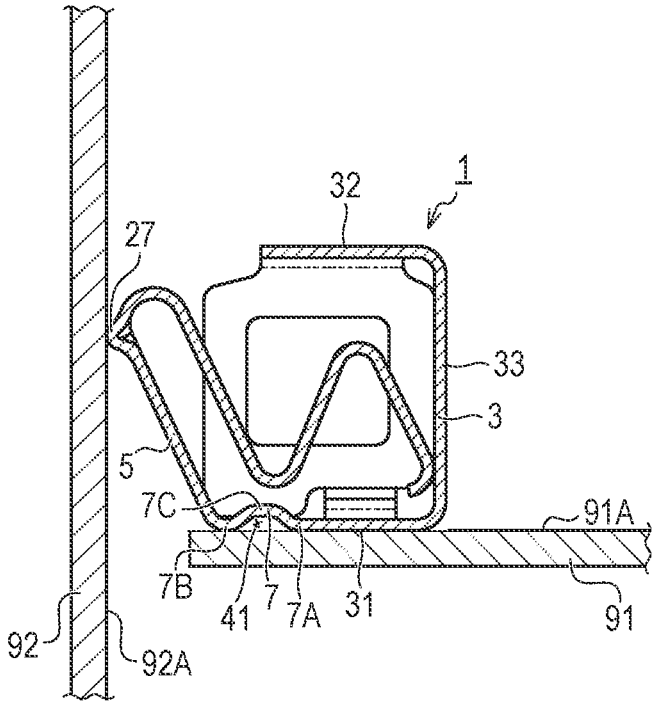
FIG. 4B is a cross-sectional view illustrating a state in which the contact of the first embodiment soldered on the first member at the first bonding surface is in pressurized contact with the second member.

FIGS. 4A and 4B illustrate the contact 1 soldered on the component mounting surface 91A of the first member 91 by using the first bonding surface 31. In a case in which the first bonding surface 31 is soldered on the component mounting surface 91A, the second bonding surface 32 may be used as the suction surface for sucking with a suction nozzle of an automatic mounting machine. In the case in which the contact 1 is soldered on the first member 91 at the first bonding surface 31, when any one of the first member 91 and the second member 92 is relatively moved with respect to the other from a position illustrated in FIG. 4A to a position illustrated in FIG. 4B, the elastic contacting portion 5 is in pressurized contact at the projecting portion 27 with the contacted surface 92A of the second member 92.

The gap forming portion 7 is configured connecting to the base portion 3 at a first end portion 7A, and connecting to the elastic contacting portion 5 at a second end portion 7B on the opposite side of the first end portion 7A. In the gap forming portion 7, a concave portion 7C is provided between the first end portion 7A and the second end portion 7B, as illustrated in FIGS. 4A and 4B. The concave portion 7C is of a shape whose lower surface in the drawing is concaved upwards; when the base portion 3 is soldered on the component mounting surface 91A of the first member 91 by using the first bonding surface 31, the concave portion 7C and the component mounting surface 91A are in a state oriented to face each other, and a gap 41 is created between the concave portion 7C and the component mounting surface 91A.

Accordingly, when soldering the contact 1 on the first member 91, even if the solder melts between the first bonding surface 31 and the component mounting surface 91A of the first member 91, the molten solder can be prevented from reaching the second edge 7B side by overwhelming the gap 41. Accordingly, it is possible to prevent a solder fillet from forming at a lower end of the elastic contacting portion 5 by the gap forming portion 7, thus allowing for the elastic contacting portion 5 to function with the spring property as designed.

Figure 5A:
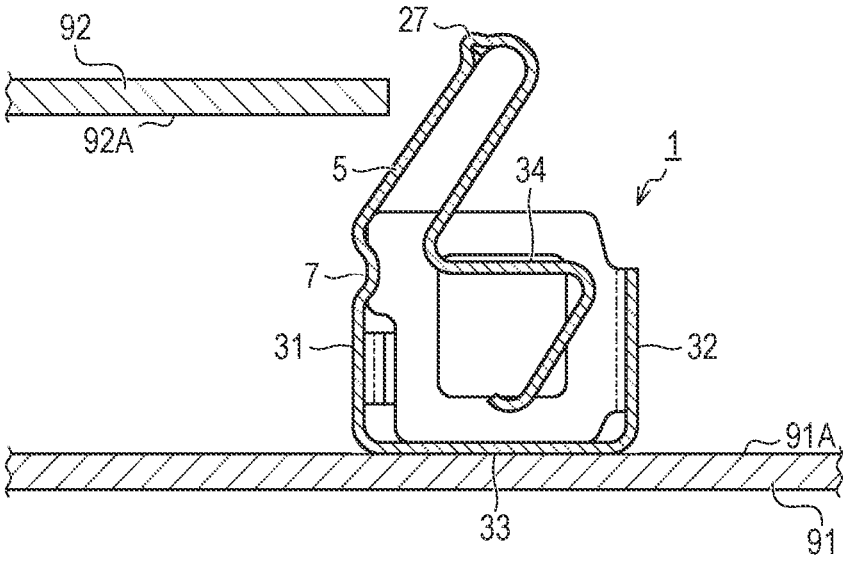
FIG. 5A is a cross-sectional view illustrating the contact of the first embodiment soldered on the first member at a third bonding surface.
Figure 5B:
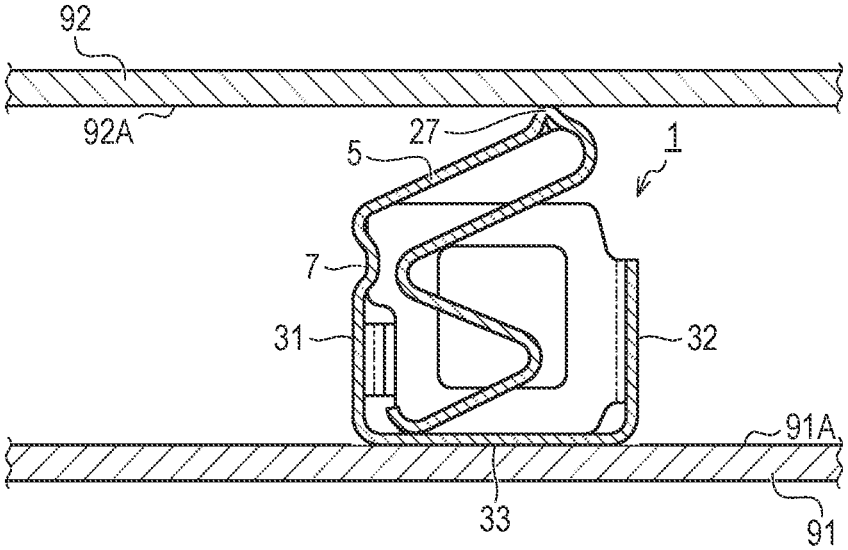
FIG. 5B is a cross-sectional view illustrating a state in which the contact of the first embodiment soldered on the first member at the third bonding surface is in pressurized contact with the second member.

FIGS. 5A and 5B illustrate the contact 1 soldered on the component mounting surface 91A of the first member 91 by using the third bonding surface 33. In a case in which the third bonding surface 33 is soldered on the component mounting surface 91A, the flat surface 34 of the elastic contacting portion 5 may be used as the suction surface for sucking with a suction nozzle of an automatic mounting machine. In the case in which the contact 1 is soldered on the first member 91 at the third bonding surface 33, when any one of the first member 91 and the second member 92 is relatively moved with respect to the other from a position illustrated in FIG. 5A to a position illustrated in FIG. 5B, the elastic contacting portion 5 is in pressurized contact at the projecting portion 27 with the contacted surface 92A of the second member 92.

As illustrated in FIG. 4B, in a case in which the elastic contacting portion 5 is in pressurized contact with the contacted surface 92A arranged perpendicular to the component mounting surface 91A, the closer a mounted position of the contact 1 on the component mounting surface 91A is to the contacted surface 92A, the larger a magnitude Fx of a force applied on the contacted surface 92A from the elastic contacting portion 5 is. When the force applied on the contacted surface 92A from the elastic contacting portion 5 is too small, electric resistance between the contact 1 and the contacted surface 92A increases. On the other hand, if the force applied on the contacted surface 92A from the elastic contacting portion 5 is too large, load is applied on a soldered location between the contact 1 and the first member 91; this may cause breakage of the soldered part or the first member 91.

On this account, when the elastic contacting portion 5 is mounted on the component mounting surface 91A, it is recommended to mount the contact 1 at a position in which the magnitude Fx of the force applied on the contacted surface 92A from the elastic contacting portion 5 is not less than a lower limit value Fmin and not more than an upper limit value Fmax each defined in advance. The lower limit value Fmin and the upper limit value Fmax may be determined as appropriate depending on the size and use of the contact 1. However, in terms of preventing the electric resistance between the contact 1 and the contacted surface 92A from becoming in excess, the lower limit value Fmin is preferably not less than 0.1 N. Moreover, in terms of preventing excess load from being applied on the soldered location between the contact 1 and the first member 91, the upper limit value Fmax is preferably not more than 30 N.

Figure 6A:
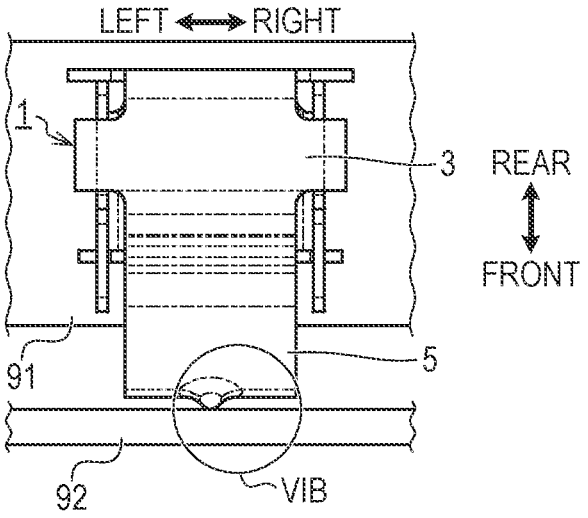
FIG. 6A is a plan view illustrating the contact of the first embodiment viewed from a direction perpendicular to a component mounting surface.
Figure 6B:
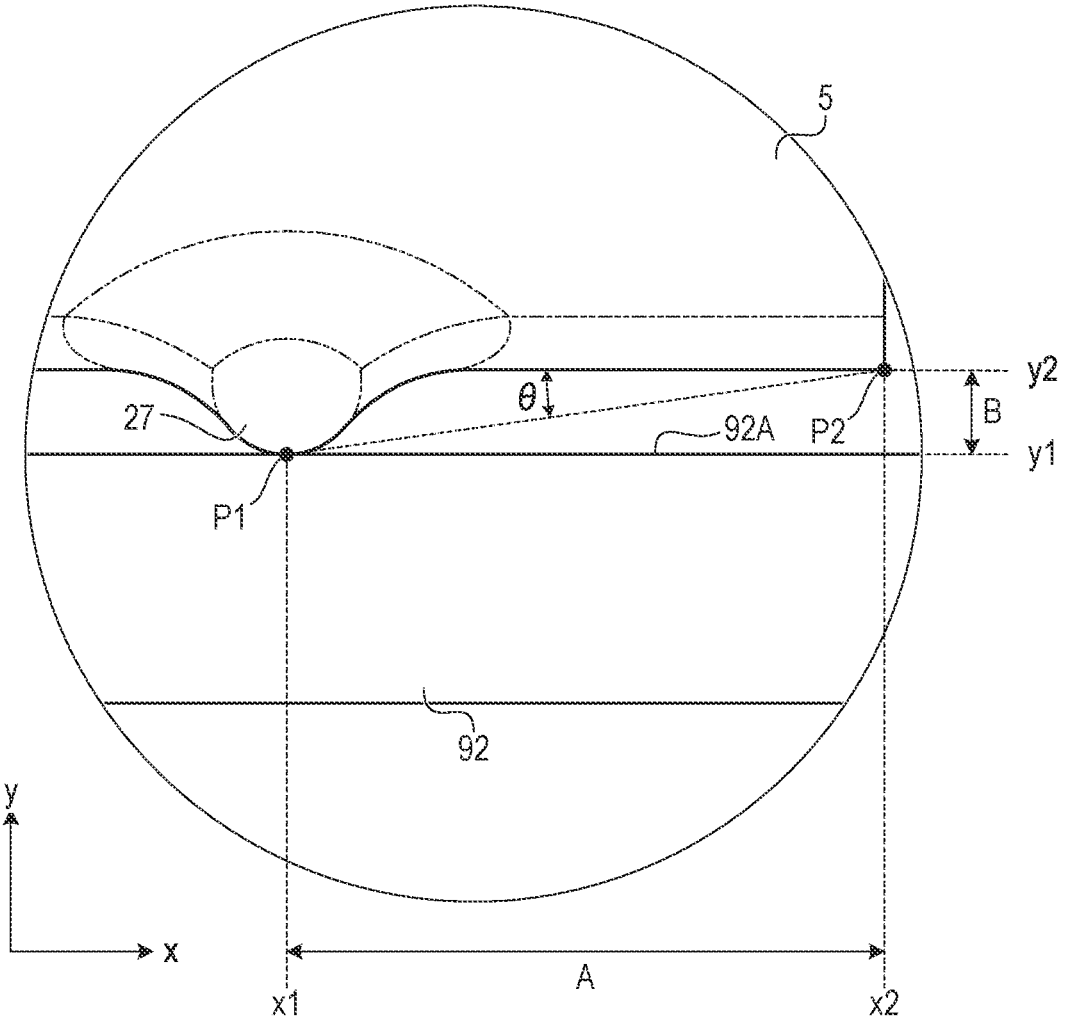
FIG. 6B is an enlargement of part VIB illustrated in FIG. 6A.
Figure 7A:
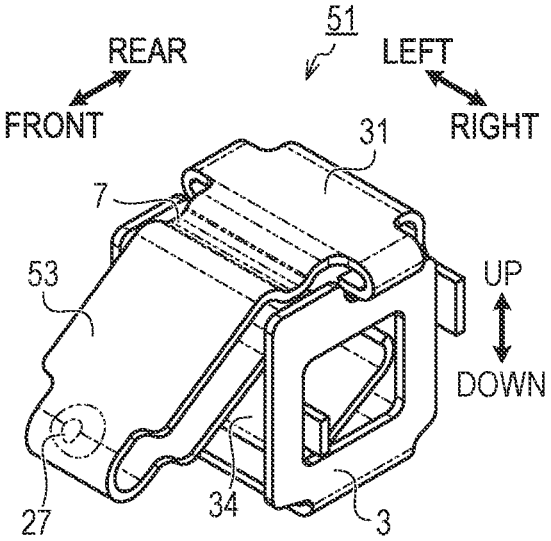
FIG. 7A is a perspective view of a contact of a second embodiment viewed from an upper right front side.
Figure 7B:
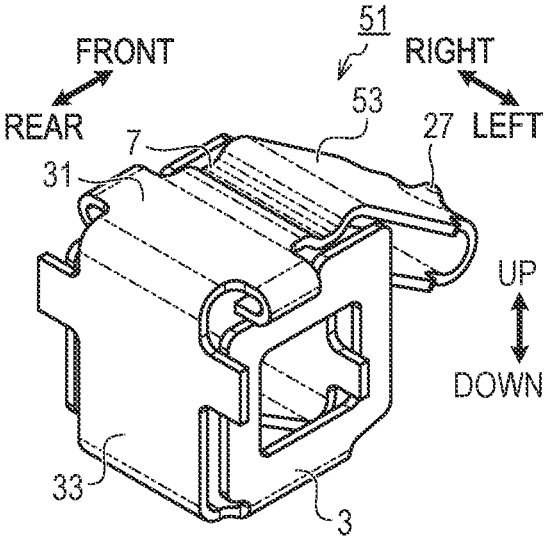
FIG. 7B is a perspective view of the contact of the second embodiment viewed from an upper left rear side.
Figure 7C:
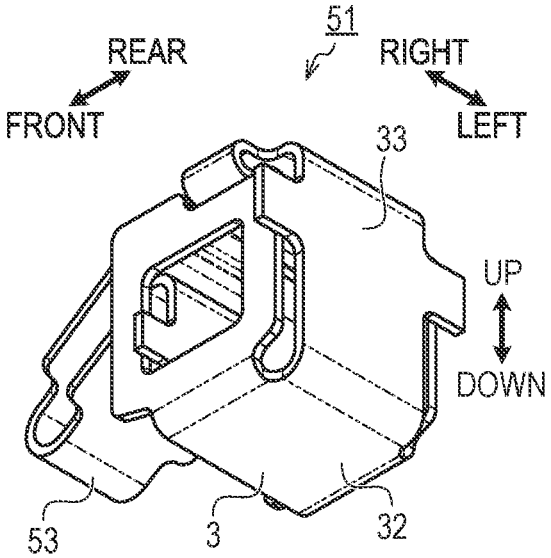
FIG. 7C is a perspective view of the contact of the second embodiment viewed from a lower right rear side.
Figure 7D:
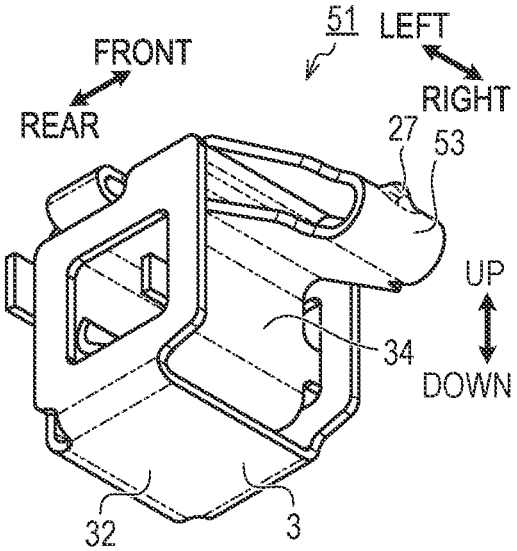
FIG. 7D is a perspective view of the contact of the second embodiment viewed from a lower left front side.

The numerical range from the lower limit value Fmin to the upper limit value Fmax may be a further narrowed numerical range as long as the range is within the numerical range of 0.1 N to 30 N described above. For example, in the case of the contact 1 of the present embodiment, recommended values for the lower limit value Fmin is 10 N and for the upper limit value Fmax is 20 N, in relationship to a spring constant of the elastic contacting portion 5. FIGS. 6A and 6B illustrate the protruding direction tip portion and a protruding portion of the elastic contacting portion 5 viewed from a direction perpendicular to the component mounting surface 91A, in a state in which the elastic contacting portion 5 contacts the contacted surface 92A by the force of the magnitude Fx within the numerical range from the recommended lower limit value Fmin to the upper limit value Fmax.

The contact 1 of the present embodiment, in a case of viewing from the direction illustrated in FIGS. 6A and 6B, is configured in such a manner that a position of an apex P1 of the projecting portion 27 (x1, y1) and a position of an edge P2 of the protruding direction tip portion of the elastic contacting portion 5 (x2, y2) are arranged at positions satisfying a distance $A=x2-x1$, a protruding height $B=y2-y1$, $B/A>\tan 5°$, wherein a width direction of the elastic contacting portion 5 perpendicular to the protruding direction of the projecting portion 27 is an x-axis direction, and the protruding direction of the projecting portion 27 is a y-axis direction. In a state illustrated in FIG. 6B, a degree θ in the drawing is approximately 8°, and $B/A\approx \tan 8°$ s.

When the aforementioned distance A and the protruding height B are configured to satisfy B/A>tan 5°, even if a θ shift occurs within a range of ±5 degrees at the time of mounting the contact 1, the elastic contacting portion 5 can suitably be in pressurized contact with the mounted surface of the second member 92 at the projecting portion 27. The θ shift in this specification is a shift in an angle of the mounting position of the contact 1 in a rotating direction whose center of rotation is an axis extending in the up-down direction in the drawing.

In a case in which the protruding height B of the projecting portion 27 is excessively small and is B/A≤tan 5°, just a θ shift occurs within the range of ±5 degrees at the time of mounting the contact 1, and the edge P2 of the elastic contacting portion 5 (see FIG. 6B) contacts the contacted surface 92A. Moreover, even in a case in which the aforementioned distance A is excessively large and is B/A≤tan 5°, just a θ shift occurs within the range of ±5 degrees at the time of mounting the contact 1, and the edge P2 of the elastic contacting portion 5 contacts the contacted surface 92A. Therefore, to make the elastic contacting portion 5 be suitably in pressurized contact with the mounted surface of the second member 92 at the projecting portion 27, the lower limit value Fmin and the upper limit value Fmax as described above is to be selected upon assuming a used state of the contact 1, and the distance A and the protruding height B described above is to be set to satisfy B/A>tan 5° in a case in which the elastic contacting portion 5 contacts the contacted surface 92A with the force of the magnitude Fx within the numerical range of from the lower limit value Fmin to the upper limit value Fmax.

In the case of the present embodiment, the projecting portion 27 is provided at a center in the width direction of the protruding direction tip portion of the elastic contacting portion 5. Therefore, although FIGS. 6A and 6B illustrate an edge at the right front end of the elastic contacting portion 5, even when an edge at a left front end of the elastic contacting portion 5 is intended, the distance A will be of equal length as with the case of intending the edge at the right front end of the elastic contacting portion 5. In a case in which the projecting portion 27 is biased to the left than the center in the width direction at the protruding direction tip portion of the elastic contacting portion 5, the distance A described above is to be of a distance intending the edge of the right front end of the elastic contacting portion 5. In a case in which the projecting portion 27 is biased to the right than the center in the width position at the protruding direction tip portion of the elastic contacting portion 5, the distance A described above is to be of a distance intending the edge of the left front end of the elastic contacting portion 5.

[Effect]

According to the contact 1 described above, the gap forming portion 7 is provided between the base portion 3 and the elastic contacting portion 5, and when the base portion 3 is soldered on the component mounting surface 91A, the gap 41 is formed between the concave portion 7C of the gap forming portion 7 and the first member 91. Therefore, when the base portion 3 is soldered on the first member 91, even if the solder melts between the base portion 3 and the first member 91, it is extremely low in possibility that the molten solder reaches the elastic contacting portion 5 by overwhelming the position of the gap 41. Accordingly, it is possible to prevent a solder fillet from forming at one end of the elastic contacting portion 5, thus allowing for the elastic contacting portion 5 to function with the spring property as designed.

Moreover, in the case of the contact 1 described above, the aforementioned distance A and the protruding height B of the projecting portion 27 are configured to satisfy B/A>tan 5°; hence, even if the θ shift occurs within the range of ±5 degrees at a mounted position of the contact 1, the projecting portion 27 can contact the contacted surface 92A of the second member 92 properly.

Moreover, the contact 1 described above has the first bonding surface 31, the second bonding surface 32, and the third bonding surface 33; hence, it is possible to solder the contact 1 on the component mounting surface 91A of the first member 91 upon orienting the contact 1 to any one of the three types of directions, to solder. Even further, any one of the second bonding surface 32, the first bonding surface 31, and the flat surface 34 may be used as the aforementioned suction surface; in a case in which the contact 1 is soldered by being oriented to any one of the three directions described above, it is possible to mount the contact 1 on the component mounting surface 91A with an automatic mounting machine.

(2) Second Embodiment

Next describes a second embodiment. The second embodiment just modifies one portion of the configuration illustrated in the first embodiment. Therefore, mainly the differences from the first embodiment will be described in detail, and descriptive explanations for parts similar to the first embodiment will be omitted.

Figure 8A:
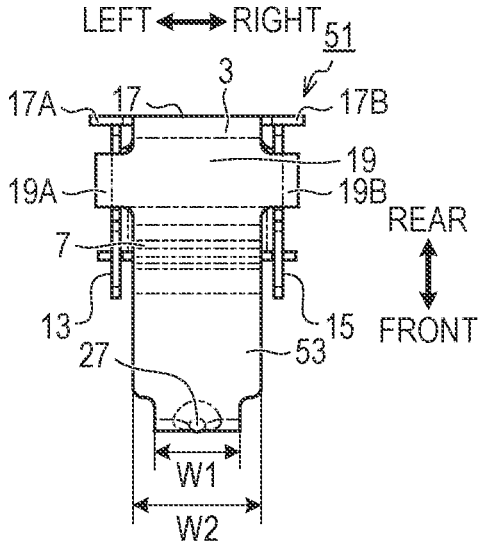
FIG. 8A is a plan view of the contact of the second embodiment.
Figure 8B:
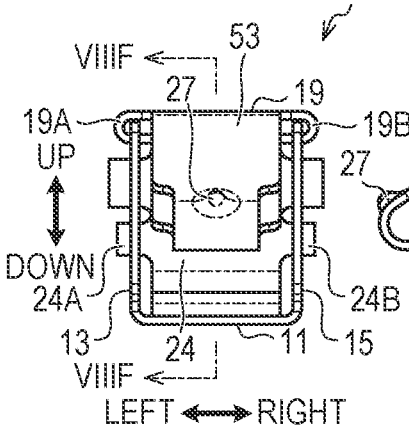
FIG. 8B is a front view of the contact of the second embodiment.
Figure 8C:
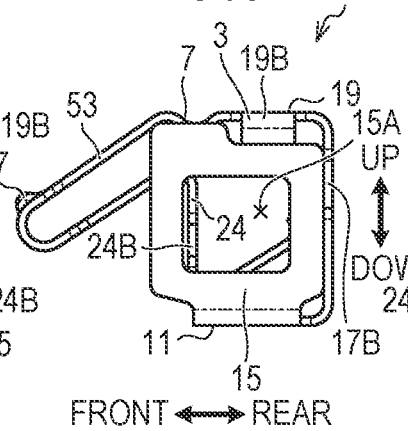
FIG. 8C is a right side view of the contact of the second embodiment.
Figure 8D:
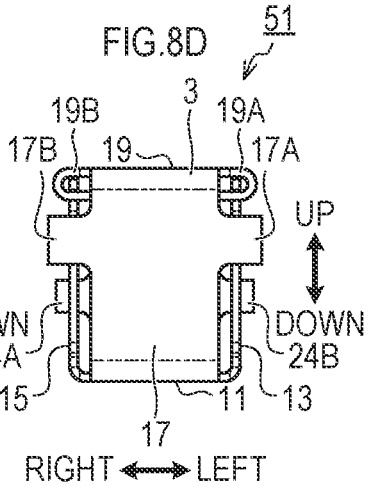
FIG. 8D is a rear view of the contact of the second embodiment.
Figure 8E:
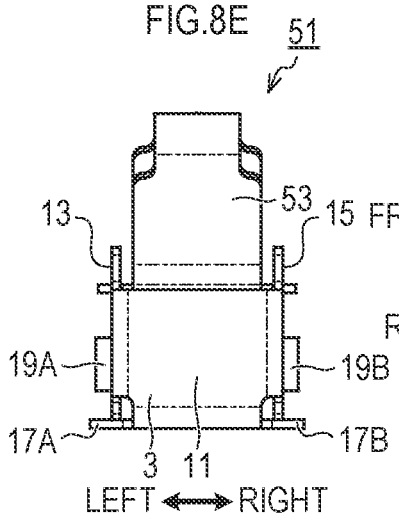
FIG. 8E is a bottom view of the contact of the second embodiment.
Figure 8F:
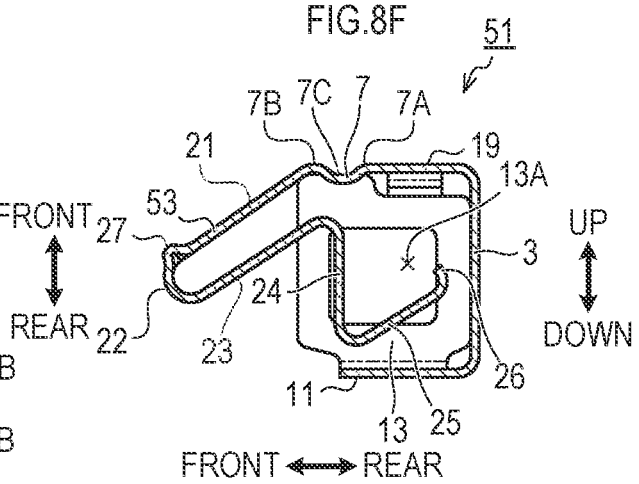
FIG. 8F is a cross-sectional view of a cross section taken on line VIIIF-VIIIF in FIG. 8B.

A contact 51 illustrated in FIGS. 7A, 7B, 7C, 7D, 8A, 8B, 8C, 8D, 8E, and 8F include the base portion 3, an elastic contacting portion 53, and the gap forming portion 7. The base portion 3 and the gap forming portion 7 are completely the same as the contact 1 of the first embodiment. On the other hand, the elastic contacting portion 53 differs from the elastic contacting portion 5 of the first embodiment in one portion of its shape. More specifically, in the case of the contact 51 of the second embodiment, the elastic contacting portion 53 is configured in such a manner that, as illustrated in FIG. 8A, in one portion including the protruding direction tip portion of the elastic contacting portion 53, a width W1 being that one portion is narrower than a width W2 of the other parts excluding the one portion.

By employing such a configuration, even if the width W2 of the elastic contacting portion 53 is the same as the elastic contacting portion 5 of the first embodiment, the width W1 at the protruding direction tip portion of the elastic contacting portion 53 becomes narrower than the width W2. Therefore, the distance A=x2−x1 described in the first embodiment becomes shorter than the elastic contacting portion 5 of the first embodiment, and B/A becomes a larger value. Accordingly, with the contact 51 of the second embodiment, a further greater θ shift is allowable than the contact 1 of the first embodiment.

Moreover, although the protruding direction tip portion of the elastic contacting portion 53 is configured with the width W1, components other than the protruding direction tip portion are configured with the width W2. Therefore, different from the case in which the entire elastic contacting portion 53 is in the width W1, it is possible to prevent weakening of elastic force of the elastic contacting portion 53. Namely, making just the protruding direction tip portion of the elastic contacting portion 53 be the width W1 allows for addressing greater θ shifts without reducing the elastic force of the elastic contacting portion 53.

(3) Other Embodiments

The above describes the contact of the present disclosure by raising illustrative embodiments, however the aforementioned embodiments merely illustrate one aspect of the present disclosure. Namely, the present disclosure is not limited to the aforementioned illustrative embodiments, and may be implemented in various forms within a range not departing from the technical idea of the present disclosure.

For example, in the above embodiments, the base portion 3 is provided with the first bonding surface 31, the second bonding surface 32 and the third bonding surface 33; regarding the second bonding surface 32 and the third bonding surface 33, one of either may be not provided, or both may not be provided.

Moreover, in the above embodiments, regarding the shape of the concave portion 7C of the gap forming portion 7, a shape drawing an arc when viewed from the left-right direction was illustrated as one example, however the shape of the concave portion 7C is not limited to the shape as illustrated. Namely, the concave portion 7C may be any shape, as long as a desired gap 41 is formed when the concave portion 7C and the component mounting surface 91A are oriented to face each other.

Other than the above, a function achieved by one component in the above embodiments may be configured to be achieved by a plurality of components. Moreover, a function achieved by a plurality of components may be achieved by one component. Moreover, one portion of the configuration of the above embodiments may be omitted. Moreover, at least one portion of the configuration of the above embodiments may be added, substituted or the like to the configuration of another one of the above embodiments.

(4) Supplement

As obvious from the illustrated embodiments described above, the contact of the present disclosure may further include the following configurations.

In one aspect of the present disclosure, the elastic contacting portion may be configured capable of being in pressurized contact with a contacted surface, at a projecting portion provided around a protruding direction tip portion. In a case in which the base portion is soldered on the component mounting surface and the elastic contacting portion is in pressurized contact with a contacted surface arranged perpendicular to the component mounting surface, and in a state in which a magnitude Fx of a force applied on the contacted surface from the elastic contacting portion is not less than a lower limit value Fmin and not more than an upper limit value Fmax set in advance (however, Fx, Fmin and Fmax are values satisfying $0.1 \leq Fmin \leq Fx \leq Fmax \leq 30$, and the unit being N), a position of an apex of the projecting portion (x1, y1) and a position of an edge of the protruding direction tip portion of the elastic contacting portion (x2, y2) may be arranged at positions satisfying distance $A=x2-x1$, protruding height $B=y2-y1$, $B/A>\tan 5°$, wherein a width direction of the elastic contacting portion perpendicular to the protruding direction of the projecting portion is an x-axis direction, and the projecting direction of the projecting portion is the y-axis direction, viewing the elastic contacting portion from a direction perpendicular to the component mounting surface.

In one aspect of the present disclosure, the elastic contacting portion may be configured in such a manner that, in one portion including the protruding direction tip portion of the elastic contacting portion, a width of a band-shaped sheet metal is narrowed more than a part other than the one portion.

In one aspect of the present disclosure, the base portion has the first bonding surface and the second bonding surface, and may be configured to have a gap between the concave portion and the component mounting surface in a case in which the first bonding surface is used to be soldered on the component mounting surface. The first bonding surface and the second bonding surface are arranged in parallel and oriented in directions opposite each other, and among the first bonding surface and the second bonding surface, in a case in which any one of the bonding surfaces is soldered on the component mounting surface, the other one of the bonding surfaces may be configured usable as a suction surface for sucking with a suction nozzle of an automatic mounting machine.

In one aspect of the present disclosure, the base portion may have a third bonding surface oriented in a direction perpendicular to the directions in which the first bonding surface and the second bonding surface are oriented. The elastic contacting portion is provided with a flat surface arranged parallel to the third bonding surface and oriented in a direction opposite to the third bonding surface; in a case in which the third bonding surface is soldered on the component mounting surface, the flat surface may be configured usable as a suction surface for sucking with a suction nozzle of an automatic mounting machine.

REFERENCE SIGNS

1, 51 . . . Contact, 3 . . . Base portion, 5, 53 . . . Elastic contacting portion, 7 . . . Gap forming portion, 7A . . . First end portion, 7B . . . Second end portion, 7C . . . Concave portion, 11 . . . Bottom plate portion, 13 . . . Left wall portion, 13A . . . Left opening, 15 . . . Right wall portion, 15A . . . Right opening, 17 . . . Rear wall portion, 17A . . . Left protruding piece, 17B . . . Right protruding piece, 19 . . . Top plate portion, 19A . . . Left folding piece, 19B . . . Right folding piece, 21 . . . First inclined portion, 22 . . . Front end folding portion, 23 . . . Second inclined portion, 24 . . . Front wall portion, 24A . . . Left restricting piece, 24B . . . Right restricting piece, 25 . . . Third inclined portion, 26 . . . Rear curved portion, 27 . . . Projecting portion, 31 . . . First bonding surface, 32 . . . Second bonding surface, 33 . . . Third bonding surface, 34 . . . Flat surface, 41 . . . Gap, 91 . . . First member, 91A . . . Component mounting surface, 92 . . . Second member, 92A . . . Contacted surface, P1 . . . Apex, P2 . . . Edge.

The invention claimed is:

1. A contact capable of electrically connecting a first member and a second member, the contact comprising:

a base portion; an elastic contacting portion; and a gap forming portion, the base portion being configured solderable on a component mounting surface of the first member, the elastic contacting portion being configured elastically deformable and relatively swingable with respect to the base portion, and, when contacting a contacted surface of the second member, being configured to elastically deform to be in pressurized contact with the contacted surface, and the gap forming portion being formed integrally with the base portion and the elastic contacting portion, the gap forming portion being configured to connect with the base portion at a first end portion and connect with the elastic contacting portion at a second end portion on an opposite side of the first end portion, the first end portion and the second end portion having a concave portion provided therebetween, and the gap forming portion being configured to have a gap between the concave portion and the component mounting surface when the base portion is soldered on the component mounting surface in a state in which the concave portion and the component mounting surface are oriented to face each other, the base portion having a bottom plate portion, a left wall portion, a right wall portion, a rear wall portion and a top plate portion, the left wall portion having formed a left opening and the right wall portion having formed a right opening, the elastic contacting portion having a first inclined portion, a front end folding portion, a second inclined portion, a front wall portion, a third inclined portion, a rear end bent portion and a projecting portion, the front wall portion being provided with a left restricting piece penetrating through the left wall portion through the left opening, and a right restricting piece penetrating through the right wall portion through the right opening.

2. The contact according to claim 1, wherein the elastic contacting portion is configured capable of being in pressurized contact with the contacted surface at a projecting portion provided around a protruding direction tip, and in a case in which the base portion is soldered on the component mounting surface, the elastic contacting portion is in pressurized contact with the contacted surface arranged perpendicular to the component mounting surface, and in a state in which a magnitude Fx of a force applied on the contacted surface from the elastic contacting portion is not less than a lower limit value Fmin and not more than an upper limit value Fmax set in advance (wherein, Fx, Fmin and Fmax are values satisfying $0.1 \leq Fmin \leq Fx \leq Fmax \leq 30$, a unit being N), a position of an apex of the projecting portion (x1, y1) and a position of an edge of a protruding direction tip portion of the elastic contacting portion (x2, y2) may be arranged at positions satisfying a distance $A=x2-x1$, protruding height $B=y2-y1$, $B/A>\tan 5°$, wherein a width direction of the elastic contacting portion perpendicular to the protruding direction of the projecting portion is an x-axis direction, and the protruding direction of the projecting portion is a y-axis direction, viewing the elastic contacting portion from a direction perpendicular to the component mounting surface.

3. The contact according to claim 2, wherein the elastic contacting portion is configured, at one portion including the protruding direction tip portion of the elastic contacting portion, to become narrower in width of the elastic contacting portion than a part other than the one portion.

4. The contact according to claim 1, wherein the base portion has a first bonding surface and a second bonding surface, and is configured to have a gap between the concave portion and the component mounting surface in a case of being soldered on the component mounting surface by using the first bonding surface, and the first bonding surface and the second bonding surface are arranged parallel and oriented in directions opposite each other, and among the first bonding surface and the second bonding surface, in a case in which any one of the bonding surfaces is soldered on the component mounting surface, the other one of the bonding surfaces is configured usable as a suction surface for sucking with a suction nozzle of an automatic mounting machine.

5. The contact according to claim 2, wherein the base portion has a first bonding surface and a second bonding surface, and is configured to have a gap between the concave portion and the component mounting surface in a case of being soldered on the component mounting surface by using the first bonding surface, and the first bonding surface and the second bonding surface are arranged parallel and oriented in directions opposite each other, and among the first bonding surface and the second bonding surface, in a case in which any one of the bonding surfaces is soldered on the component mounting surface, the other one of the bonding surfaces is configured usable as a suction surface for sucking with a suction nozzle of an automatic mounting machine.

6. The contact according to claim 3, wherein the base portion has a first bonding surface and a second bonding surface, and is configured to have a gap between the concave portion and the component mounting surface in a case of being soldered on the component mounting surface by using the first bonding surface, and the first bonding surface and the second bonding surface are arranged parallel and oriented in directions opposite each other, and among the first bonding surface and the second bonding surface, in a case in which any one of the bonding surfaces is soldered on the component mounting surface, the other one of the bonding surfaces is configured usable as a suction surface for sucking with a suction nozzle of an automatic mounting machine.

7. The contact according to claim 4, wherein the base portion has a third bonding surface oriented in a direction perpendicular to directions in which the first bonding surface and the second bonding surface are oriented, and the elastic contacting portion is provided with a flat surface arranged parallel to the third contacting surface and oriented to a direction opposite the third bonding surface, and in a case in which the third bonding surface is soldered on the component mounting surface, the flat surface being configured usable as a suction surface for sucking with a suction nozzle of an automatic mounting machine.

8. The contact according to claim 5, wherein the base portion has a third bonding surface oriented in a direction perpendicular to directions in which the first bonding surface and the second bonding surface are oriented, and the elastic contacting portion is provided with a flat surface arranged parallel to the third contacting surface and oriented to a direction opposite the third bonding surface, and in a case in which the third bonding surface is soldered on the component mounting surface, the flat surface being configured usable as a suction surface for sucking with a suction nozzle of an automatic mounting machine.

9. The contact according to claim 6, wherein the base portion has a third bonding surface oriented in a direction perpendicular to directions in which the first bonding surface and the second bonding surface are oriented, and the elastic contacting portion is provided with a flat surface arranged parallel to the third contacting surface and oriented to a direction opposite the third bonding surface, and in a case in which the third bonding surface is soldered on the component mounting surface, the flat surface being configured usable as a suction surface for sucking with a suction nozzle of an automatic mounting machine.

10. A contact capable of electrically connecting a first member and a second member, the contact comprising:

a base portion; an elastic contacting portion; and a gap forming portion, the base portion being configured solderable on a component mounting surface of the first member, the elastic contacting portion being configured elastically deformable and relatively swingable with respect to the base portion, and, when contacting a contacted surface of the second member, being configured to elastically deform to be in pressurized contact with the contacted surface, and the gap forming portion being formed integrally with the base portion and the elastic contacting portion, the gap forming portion being configured to connect with the base portion at a first end portion and connect with the elastic contacting portion at a second end portion on an opposite side of the first end portion, the first end portion and the second end portion having a concave portion provided therebetween, and the gap forming portion being configured to have a gap between the concave portion and the component mounting surface when the base portion is soldered on the component mounting surface in a state in which the concave portion and the component mounting surface are oriented to face each other, the base portion having a bottom plate portion, a left wall portion, a right wall portion, a rear wall portion and a top plate portion, the rear wall portion having formed a left protruding piece protruding leftwards from a left end of the rear wall portion and a right protruding piece protruding rightwards from a right end of the rear wall portion, the left wall portion having formed a left opening and the right wall portion having formed a right opening, the elastic contacting portion having a first inclined portion, a front end folding portion, a second inclined portion, a front wall portion, a third inclined portion, a rear end bent portion and a projecting portion, the front wall portion being provided with a left restricting piece penetrating through the left wall portion through the left opening, and a right restricting piece penetrating through the right wall portion through the right opening, the left restricting piece being parallel to the left protruding piece and the right restricting piece being parallel to the right protruding piece.

11. A contact capable of electrically connecting a first member and a second member, the contact comprising:

a base portion; an elastic contacting portion; and a gap forming portion, the base portion being configured solderable on a component mounting surface of the first member, the elastic contacting portion being configured elastically deformable and relatively swingable with respect to the base portion, and, when contacting a contacted surface of the second member, being configured to elastically deform to be in pressurized contact with the contacted surface, and the gap forming portion being formed integrally with the base portion and the elastic contacting portion, the gap forming portion being configured to connect with the base portion at a first end portion and connect with the elastic contacting portion at a second end portion on an opposite side of the first end portion, the first end portion and the second end portion having a concave portion provided therebetween, and the gap forming portion being configured to have a gap between the concave portion and the component mounting surface when the base portion is soldered on the component mounting surface in a state in which the concave portion and the component mounting surface are oriented to face each other, the base portion having a bottom plate portion, a left wall portion, a right wall portion, a rear wall portion and a top plate portion, the rear wall portion being provided with a left protruding piece protruding towards a left direction from a left end of the rear wall portion and a right protruding piece protruding towards a right direction from a right end of the rear wall portion.

12. The contact according to claim 11, wherein the left protruding piece abuts a rear end of the left wall portion at its front surface, and the right protruding piece abuts a rear end of the right wall portion at its front surface.

13. A contact capable of electrically connecting a first member and a second member, the contact comprising:

a base portion; an elastic contacting portion; and a gap forming portion, the base portion being configured solderable on a component mounting surface of the first member, the elastic contacting portion being configured elastically deformable and relatively swingable with respect to the base portion, and, when contacting a contacted surface of the second member, being configured to elastically deform to be in pressurized contact with the contacted surface, and the gap forming portion being formed integrally with the base portion and the elastic contacting portion, the gap forming portion being configured to connect with the base portion at a first end portion and connect with the elastic contacting portion at a second end portion on an opposite side of the first end portion, the first end portion and the second end portion having a concave portion provided therebetween, and the gap forming portion being configured to have a gap between the concave portion and the component mounting surface when the base portion is soldered on the component mounting surface in a state in which the concave portion and the component mounting surface are oriented to face each other, the base portion having a bottom plate portion, a left wall portion, a right wall portion, a rear wall portion and a top plate portion, and the top plate portion being provided with a left folding piece extending leftwards from a left end of the top plate portion and bending downwards at a left end then folding back rightwards, and a right folding piece extending rightwards from a right end of the top plate portion and bending downwards at a right end then folding back leftwards.

* * * * *